US006249088B1

(12) United States Patent
Chang

(10) Patent No.: US 6,249,088 B1
(45) **Date of Patent: *Jun. 19, 2001**

(54) THREE-DIMENSIONAL LATTICE STRUCTURE BASED LED ARRAY FOR ILLUMINATION

(75) Inventor: Chin Chang, Yorktown Heights, NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/431,583

(22) Filed: Nov. 1, 1999

(51) Int. Cl.[7] ..... H05B 37/00

(52) U.S. Cl. ..... 315/185 R; 315/185 S; 315/200 A; 315/241 S; 362/800; 362/227; 362/252

(58) Field of Search ..... 315/185 R, 185 S, 315/192, 200 A, 241 S; 362/800, 252, 226, 227; 313/505, 512

(56) References Cited

U.S. PATENT DOCUMENTS 3,619,715 * 11/1971 Kim ..... 315/232
4,298,869 * 11/1981 Okuno ..... 340/782
4,329,625 * 5/1982 Nishizawa et al. ..... 315/158
5,490,049 2/1996 Montalan et al. ..... 362/240
5,726,535 * 3/1998 Yan ..... 315/185 R
5,806,965 * 9/1998 Deese ..... 362/249

* cited by examiner

*Primary Examiner*—Haissa Philogene

(57) ABSTRACT

A lighting system comprising a plurality of light-emitting diodes and a power supply source for driving current through a plurality of parallel disposed, electrically conductive branches, wherein the branches comprise at least one cell. The branches are configured to display the light-emitting diodes according to a three-dimensional arrangement. In each cell, each branch has a light-emitting diode with an anode terminal and a cathode terminal. The anode terminal of each light-emitting diode is coupled to the cathode terminal of a light-emitting diode of an adjacent branch via a shunt. The shunt further comprises a light-emitting diode. In each cell, each light-emitting diode may have a different forward voltage characteristic, while still insuring that all of the light-emitting diodes in the arrangement have the same brightness. Upon failure of one light-emitting diode in a cell, the remaining light-emitting diodes in the same cell are not extinguished and, in a multiple cell embodiment, the light-emitting diodes in the successive cells are not extinguished.

29 Claims, 7 Drawing Sheets

THREE-DIMENSIONAL LATTICE STRUCTURE BASED LED ARRAY FOR ILLUMINATION

FIELD OF THE INVENTION

This invention relates generally to lighting systems, and more particularly to an improved three-dimensional array structure for light-emitting diodes used as illumination sources.

BACKGROUND OF THE INVENTION

A light-emitting diode (LED) is a type of semiconductor device, specifically a p-n junction, which emits electromagnetic radiation upon the introduction of current thereto. Typically, a light-emitting diode comprises a semiconducting material that is a suitably chosen gallium-arsenic-phosphorus compound. By varying the ratio of phosphorus to arsenic, the wavelength of the light emitted by a light-emitting diode can be adjusted.

With the advancement of semiconductor materials and optics technology, light-emitting diodes are increasingly being used for illumination purposes. For instance, high brightness light-emitting diodes are currently being used in automotive signals, traffics lights and signs, large area displays, etc. In most of these applications, multiple light-emitting diodes are connected in an array structure so as to produce a high amount of lumens.

FIG. 1 illustrates a typical arrangement of light-emitting diodes 1 through m connected in series. Power supply source 4 delivers a high voltage signal to the light-emitting diodes via resistor $R_1$, which controls the flow of current signal in the diodes. Light-emitting diodes which are connected in this fashion usually lead to a power supply source with a high level of efficiency and a low amount of thermal stresses.

Occasionally, a light-emitting diode may fail. The failure of a light-emitting diode may be either an open-circuit failure or a short-circuit failure. For instance, in short-circuit failure mode, light-emitting diode 2 acts as a short-circuit, allowing current to travel from light-emitting diode 1 to 3 through light-emitting diode 2 without generating a light. On the other hand, in open-circuit failure mode, light-emitting diode 2 acts as an open circuit, and as such causes the entire array illustrated in FIG. 1 to extinguish.

In order to address this situation, other arrangements of light-emitting diodes have been proposed. For instance, FIG. 2(*a*) illustrates another typical arrangement of light-emitting diodes which consists of multiple branches of light-emitting diodes such as 10, 20, 30 and 40 connected in parallel. Each branch comprises light-emitting diodes connected in series. For instance, branch 10 comprises light-emitting diodes 11 through $n_1$ connected in series. Power supply source 14 provides a current signal to the light-emitting diodes via resistor $R_2$.

Light-emitting diodes which are connected in this fashion have a higher level of reliability than light-emitting diodes which are connected according to the arrangement shown in FIG. 1. In open-circuit failure mode, the failure of a light-emitting diode in one branch causes all of the light-emitting diodes in that branch to extinguish, without significantly effecting the light-emitting diodes in the remaining branches. However, the fact that all of the light-emitting diodes in a particular branch are extinguished by an open-circuit failure of a single light-emitting diode is still an undesirable result. In short-circuit failure mode, the failure of a light-emitting diode in a first branch may cause that branch to have a higher current flow, as compared to the other branches. The increased current flow through a single branch may cause it to be illuminated at a different level than the light-emitting diodes in the remaining branches, which is also an undesirable result.

Still other arrangements of light-emitting diodes have been proposed in order to remedy this problem. For instance, FIG. 2(*b*) illustrates another typical arrangement of light-emitting diodes, as employed by a lighting system of the prior art. As in the arrangement shown in FIG. 2(*a*), FIG. 2(*b*) illustrates four branches of light-emitting diodes such as 50, 60, 70 and 80 connected in parallel. Each branch further comprises light-emitting diodes connected in series. For instance, branch 50 comprises light-emitting diodes 51 through $n_5$ connected in series. Power supply source 54 provides current signals to the light-emitting diodes via resistor $R_3$.

The arrangement shown in FIG. 2(*b*) further comprises shunts between adjacent branches of light-emitting diodes. For instance, shunt 55 is connected between light-emitting diodes 51 and 52 of branch 50 and between light-emitting diodes 61 and 62 of branch 60. Similarly, shunt 75 is connected between light-emitting diodes 71 and 72 of branch 70 and between light-emitting diodes 81 and 82 of branch 80.

Light-emitting diodes which are connected in this fashion have a still higher level of reliability than light-emitting diodes which are connected according to the arrangements shown in either FIGS. 1 or 2(*a*). This follows because, in an open-circuit failure mode, an entire branch does not extinguish because of the failure of a single light-emitting diode in that branch. Instead, current flows via the shunts to bypass a failed light-emitting diode.

In the short-circuit failure mode, a light-emitting diode which fails has no voltage across it, thereby causing all of the current to flow through the branch having the failed light-emitting diode. For example, if light-emitting diode 51 short circuits, current will flow through the upper branch. Thus, in the arrangement shown in FIG. 2(*b*), when a single light-emitting diode short circuits, the corresponding light-emitting diodes 61, 71 and 81 in each of the other branches are also extinguished.

The arrangement shown in FIG. 2(*b*) also experiences other problems. For instance, in order to insure that all of the light-emitting diodes in the arrangement have the same brightness, the arrangement requires that parallel connected light-emitting diodes have matched forward voltage characteristics. For instance, light-emitting diodes 51, 61, 71 and 81, which are parallel connected, must have tightly matched forward voltage characteristics. Otherwise, the current signal flow through the light-emitting diodes will vary, resulting in the light-emitting diodes having dissimilar brightness.

In order to avoid this problem of varying brightness, the forward voltage characteristics of each light-emitting diode must be tested prior to its usage. In addition, sets of light-emitting diodes with similar voltage characteristics must be binned into tightly grouped sets (i.e.—sets of light-emitting diodes for which the forward voltage characteristics are nearly identical). The tightly grouped sets of light-emitting diodes must then be installed in a light-emitting diode arrangement parallel to each other. This binning process is costly, time-consuming and inefficient.

A light-emitting diode arrangement was proposed in Applicant's co-pending application, which is incorporated herein by reference as fully as if set forth in its entirety. However, there exists a further need for an improved three-dimensional light-emitting diode arrangement which does not suffer from the problems of the prior art.

SUMMARY OF THE INVENTION

In accordance with one embodiment of the present invention, a lighting system comprises a plurality of light-emitting diodes. The lighting system further comprises a current driver for driving a current signal through a plurality of parallel disposed, electrically conductive branches, wherein the branches are configured to form a three-dimensional arrangement. Each light-emitting diode in one branch together with corresponding light-emitting diodes in the remaining branches define a cell unit. In each cell, the anode terminal of each light-emitting diode in one branch is coupled to the cathode terminal of a corresponding light-emitting diode of an adjacent branch via a shunt. According to one embodiment, each shunt further comprises a light-emitting diode.

The three-dimensional arrangement enables the lighting system to be viewed from various different directions, thus rendering the system particularly well-suited for applications such as desk lamps, traffic signals, safety lights, advertising signs, etc. In another embodiment, the three-dimensional arrangement is configured such that each of the light-emitting diodes is arranged on a panel for display.

In one embodiment of the invention, the lighting system comprises three branches and has a triangular cross-section. In another embodiment, the lighting system comprises six branches and has a hexagonal cross-section. Irrespective of the number of branches, the lighting system may also comprise at least one central branch having additional branches disposed therearound. In one embodiment of the invention, at least one of the branches are coupled to the central branch, while in another embodiment, each of the branches are coupled to the central branch.

In still another embodiment, each branch of a cell is coupled to two or more other branches in the cell. Thus, in each cell, the anode terminal of a light-emitting diode in one branch may be coupled to the cathode terminal of corresponding light-emitting diodes of a plurality of adjacent branches via shunts. According to this embodiment, each of the shunts may further comprise a light-emitting diode.

The arrangement of light-emitting diodes according to the present invention enables the use of light-emitting diodes having different forward voltage characteristics, while still insuring that all of the light-emitting diodes in the arrangement have substantially the same brightness. Advantageously, the lighting system of the present invention is configured such that, upon failure of one light-emitting diode in a branch, the remaining light-emitting diodes in that branch are not extinguished. In another embodiment, the lighting system comprises at least two cells which are cascading, wherein the cascading cells are successively coupled such that the cathode terminal of each light-emitting diode in a branch is coupled to an anode terminal of a light-emitting diode of the same branch in a next successive cell.

In a preferred embodiment, each branch of the lighting system includes a current-regulating element, such as a resistor, coupled for example, as the first and the last element in each branch.

BRIEF DESCRIPTION OF THE DRAWINGS

The present invention will be further understood from the following description with reference to the accompanying drawings, in which:

FIG. 2(*b*) illustrates another typical arrangement of light-emitting diodes, as employed by a lighting system of the prior art;

FIG. 3(*b*) illustrates a cross-section of the three-dimensional arrangement, in accordance with one embodiment of the present invention;

FIG. 3(*c*) illustrates an extended cross-section of the three-dimensional arrangement of light-emitting diodes, in accordance with another embodiment of the present invention;

FIG. 4(*b*) illustrates a cross-section of the three-dimensional arrangement, in accordance with one embodiment of the present invention;

FIG. 4(*c*) illustrates an extended cross-section of the three-dimensional arrangement of light-emitting diodes, in accordance with another embodiment of the present invention;

FIG. 5(*b*) illustrates a cross-section of the three-dimensional arrangement, in accordance with one embodiment of the present invention; and FIG. 5(*c*) illustrates an extended cross-section of the three-dimensional arrangement of light-emitting diodes, in accordance with another embodiment of the present invention.

DETAILED DESCRIPTION OF THE INVENTION

Figure 3A:
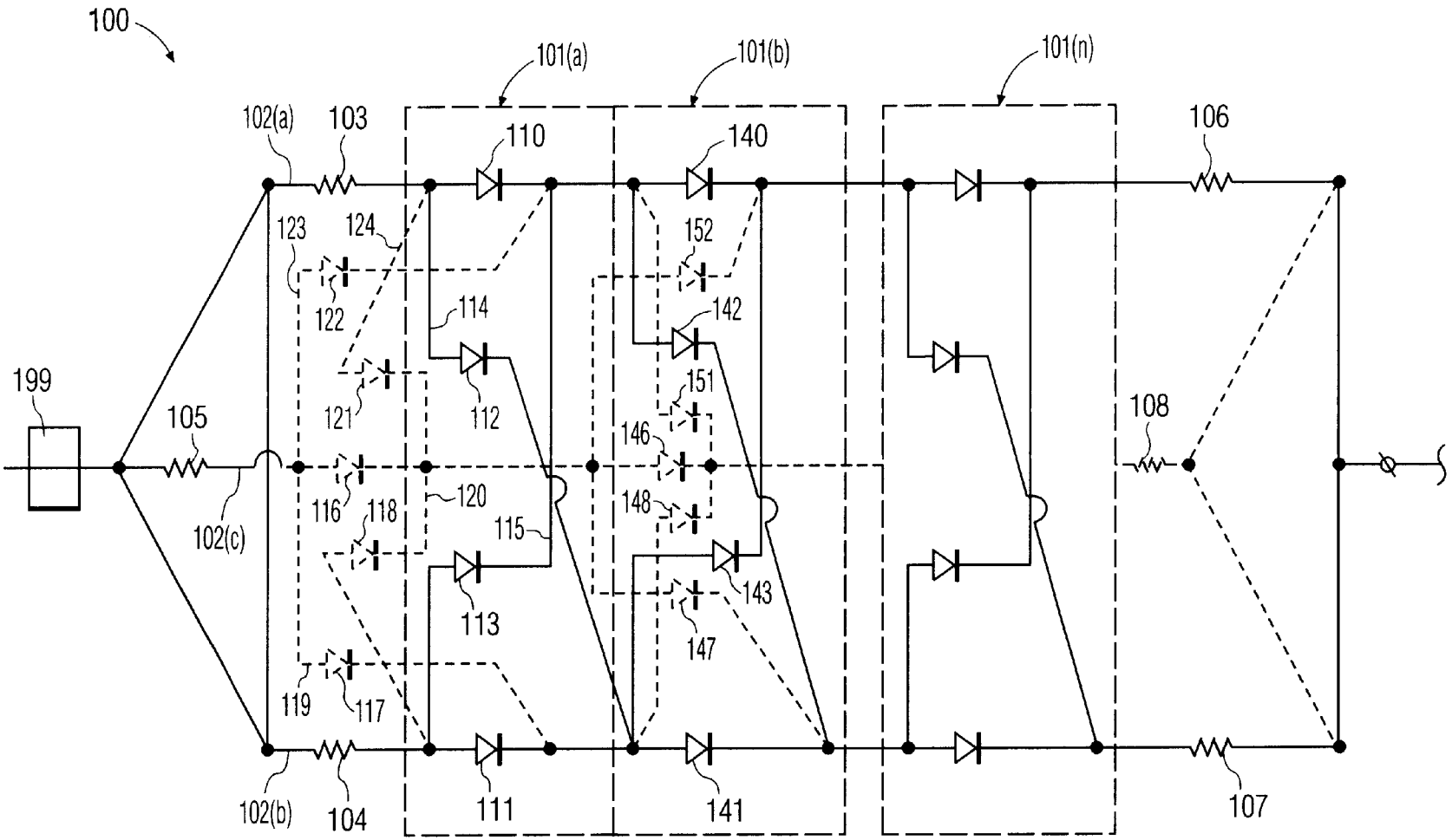
FIG. 3(*a*) illustrates a three-dimensional arrangement of light-emitting diodes, in accordance with one embodiment of the present invention.
Figure 3B:
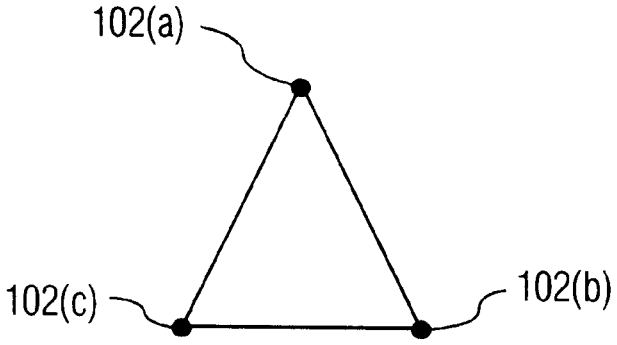
Figure 3C:
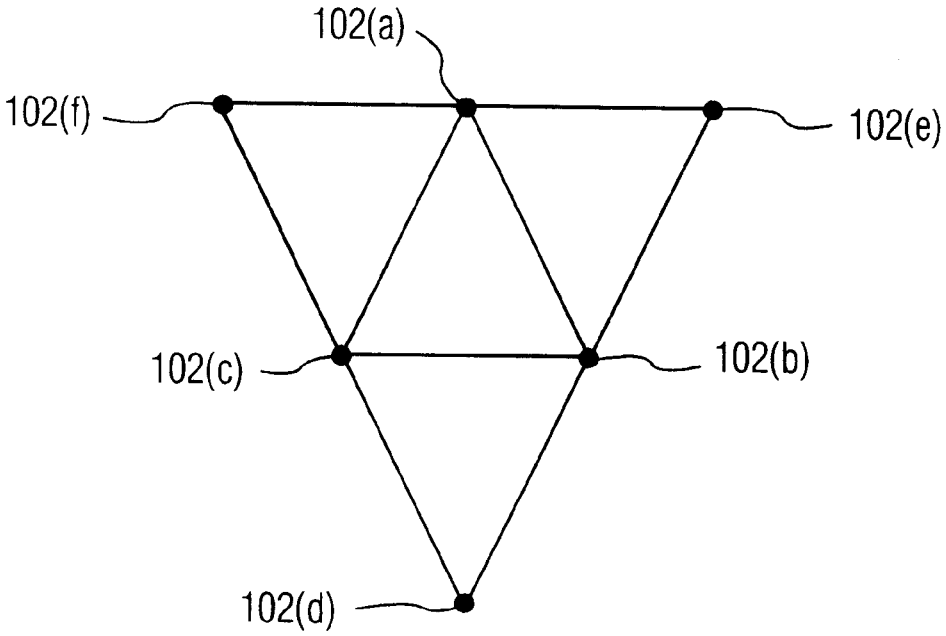

FIG. 3(*a*) illustrates an arrangement 100 of light-emitting diodes, as employed by a lighting system, according to one embodiment of the present invention. The lighting system comprises a plurality of electrically-conductive branches, wherein the branches are configured to form a three-dimensional arrangement. It is noted that, in accordance with various embodiments of the present invention, the arrangement may be configured such that each of the light-emitting diodes is arranged on a panel for display.

In the embodiment shown, the lighting system comprises three branches and has a triangular cross-section. The triangular cross-section is also illustrated in FIG. 3(*b*), although the present invention is not limited in scope in this regard. Each of the branches 102(*a*), 102(*b*) and 102(*c*) of FIG. 3(*a*) is designated as branch end nodes 102(*a*), 102(*b*) and 102(*c*) in FIG. 3(*b*). FIG. 3(*c*) illustrates another embodiment, in which the triangular cross-section is repeated, on each of its sides, so as to form three additional triangular cross-sections, with a total of six branches, wherein the end of each branch is designated by branch end nodes 102(*a*) through 102(*f*). The present invention contemplates that any number of branches and any shape of cross-section may be employed.

Returning to FIG. 3(*a*), each branch has light-emitting diodes which are connected in series. A set of corresponding light-emitting diodes of all branches defines a cell. The arrangement shown in FIG. 3(*a*) illustrates cascading cells 101(*a*), 101(*b*) through 101(*n*) of light-emitting diodes. It is noted that, in accordance with various embodiments of the present invention, any number of cells may be formed.

Each cell 101 of arrangement 100 comprises a first light-emitting diode (such as light-emitting diode 110) of branch 102(*a*), a first light-emitting diode (such as light-emitting diode 111) of branch 102(*b*), and a first light-emitting diode (such as light-emitting diode 116) of branch 102(*c*). Each of the branches having the light-emitting diodes are initially (i.e.—before the first cell) coupled in parallel via resistors (such as resistors 103, 104 and 105). The resistors preferably have the same resistive values, to insure that an equal amount of current is received via each branch.

The anode terminal of the light-emitting diode in each branch is coupled to the cathode terminal of corresponding light-emitting diodes in adjacent branches. For example, the anode terminal of light-emitting diode 110 is connected to the cathode terminal of light-emitting diode 111 by a shunt (such as shunt 114) having a light-emitting diode (such as light-emitting diode 112) connected therein. Furthermore, the anode terminal of light-emitting diode 110 is connected to the cathode terminal of light-emitting diode 116 by a shunt (such as shunt 124) having a light-emitting diode (such as light-emitting diode 121) connected therein.

Similarly, the anode terminal of light-emitting diode 111 is connected to the cathode terminal of light-emitting diode 110 by a shunt (such as shunt 115) having a light-emitting diode (such as light-emitting diode 113) connected therein. The anode terminal of light-emitting diode 111 is also connected to the cathode terminal of light-emitting diode 116 by a shunt (such as shunt 120) having a light-emitting diode (such as light-emitting diode 118) connected therein. Power supply source 199 provides a current signal to the light-emitting diodes via resistors 103, 104 and 105. Additional resistors 106, 107 and 108 are employed is in arrangement 100 at the cathode terminals of the last light-emitting diodes in each branch.

Figure 1:
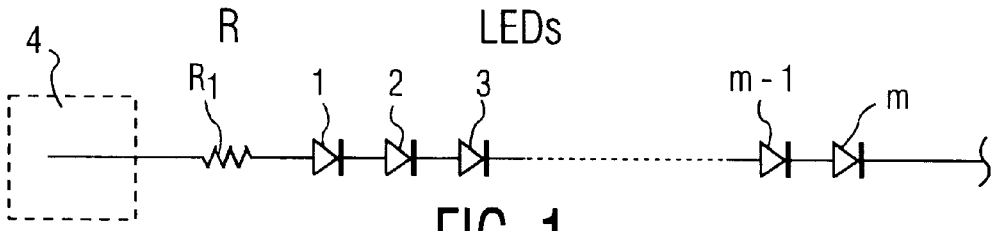
FIG. 1 PRIOR ART
FIG. 1 illustrates a typical arrangement of light-emitting diodes, as employed by a lighting system of the prior art.
Figure 2A:
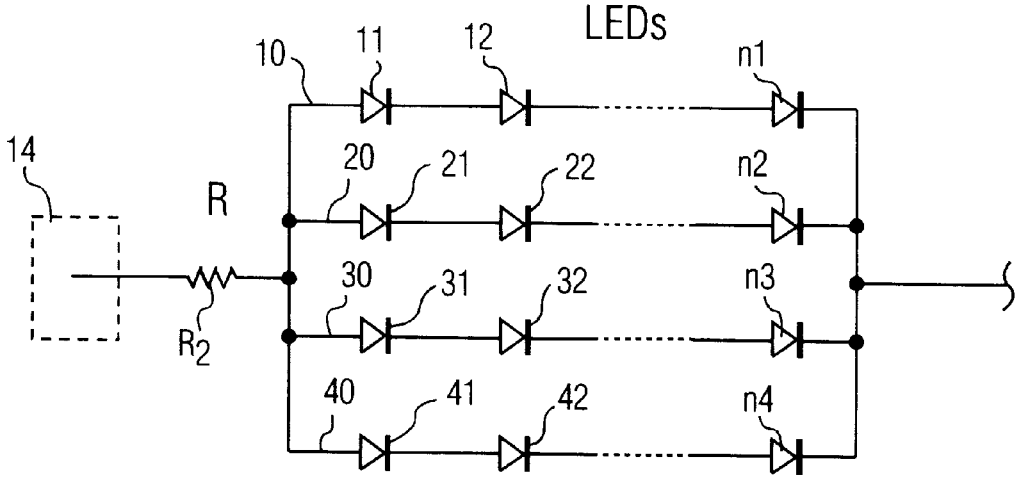
FIG. 2a PRIOR ART
FIG. 2(*a*) illustrates another typical arrangement of light-emitting diodes, as employed by a lighting system of the prior art.
Figure 2B:
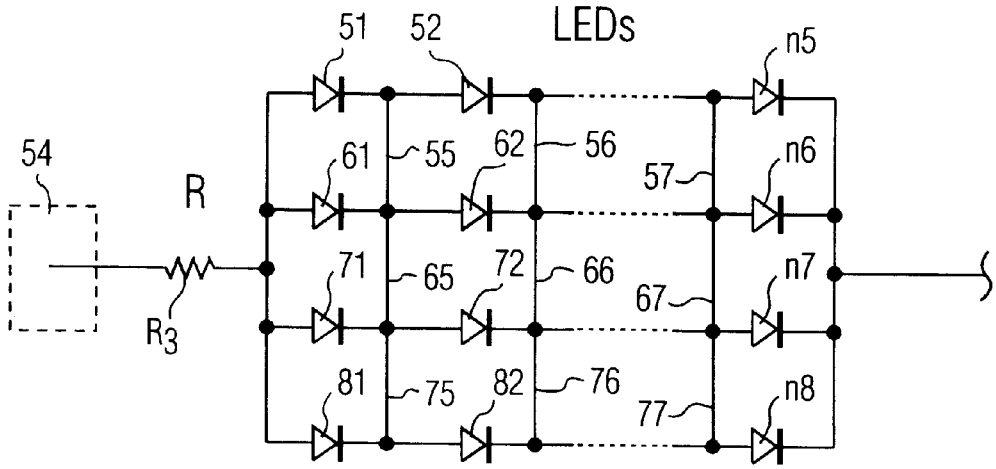
FIG. 2b PRIOR ART

Light-emitting diodes which are connected according to the arrangement shown in FIG. 3(*a*) have a level of reliability which is comparable to light-emitting diodes which are connected according to the arrangement shown in FIG. 2(*b*). This follows because, in open-circuit failure mode, an entire branch does not extinguish because of the failure of a light-emitting diode in that branch. Instead, current flows via shunts 114, 115, etc. to bypass a failed light-emitting diode. For instance, if light-emitting diode 110 of FIG. 3(*a*) fails, current still flows to (and thereby illuminates) light-emitting diode 140 via branch 102(*b*) and light-emitting diode 113, and via branch 102(*c*) and light-emitting diode 122. In addition, current from branch 102(*a*) still flows to adjacent branches 102(*b*) and 102(*c*) via shunts 114 and 124, respectively.

Furthermore, in short-circuit failure mode, light-emitting diodes in other branches and shunts do not extinguish because of the failure of a light-emitting diode in one branch. This follows because the light-emitting diodes are not connected in parallel. For example, if light-emitting diode 110 short circuits, current will flow through upper branch 102(*a*), which has no voltage drop, and will also flow through light-emitting diodes 112 and 121 in shunts 114 and 124, respectively. Light-emitting diodes 112 and 121 remain illuminated because the current flowing through them drops only a small amount, unlike that which occurs in the arrangement of FIG. 2(*b*). Light-emitting diodes 111 and 116, and the shunts which are coupled to their input terminals, also remain illuminated because a current flow is maintained through them via branches 102(*b*) and 102(*c*).

In addition, arrangement 100 of light-emitting diodes also alleviates other problems experienced by the light-emitting diode arrangements of the prior art. For instance, light-emitting diode arrangement 100 of the present invention, according to one embodiment, insures that all of the light-emitting diodes in the arrangement have the same brightness without the requirement that the light-emitting diodes have tightly matched forward voltage characteristics. For instance, light-emitting diodes 110, 111, 112, 113, 116, 117, 118, 121 and 122 of the arrangement shown in FIG. 3(*a*) may have forward voltage characteristics which are not as tightly matched as the forward voltage characteristics of light-emitting diodes 51, 61, 71 and 81 of the arrangement shown in FIG. 2(*b*). This follows because, unlike the arrangements of the prior art, the light-emitting diodes in cell 101 of arrangement 100 are not parallel-connected to each other.

Because light-emitting diodes in each cell are not parallel-connected, the voltage drop across the diodes does not need to be the same. Therefore, forward voltage characteristics of each light-emitting diode need not be equal to others in order to provide similar amounts of illumination. In other words, the current flow through a light-emitting diode having a lower forward voltage will not increase in order to equalize the forward voltage of the light-emitting diode with the higher forward voltage of another light-emitting diode.

Because it is not necessary to have light-emitting diodes with tightly matched forward voltage characteristics, the present invention alleviates the need for binning light-emitting diodes with tightly matched voltage characteristics. Therefore, the present invention reduces the additional manufacturing costs and time which is necessitated by the binning operation of prior art light-emitting diode arrangements.

Figure 4A:
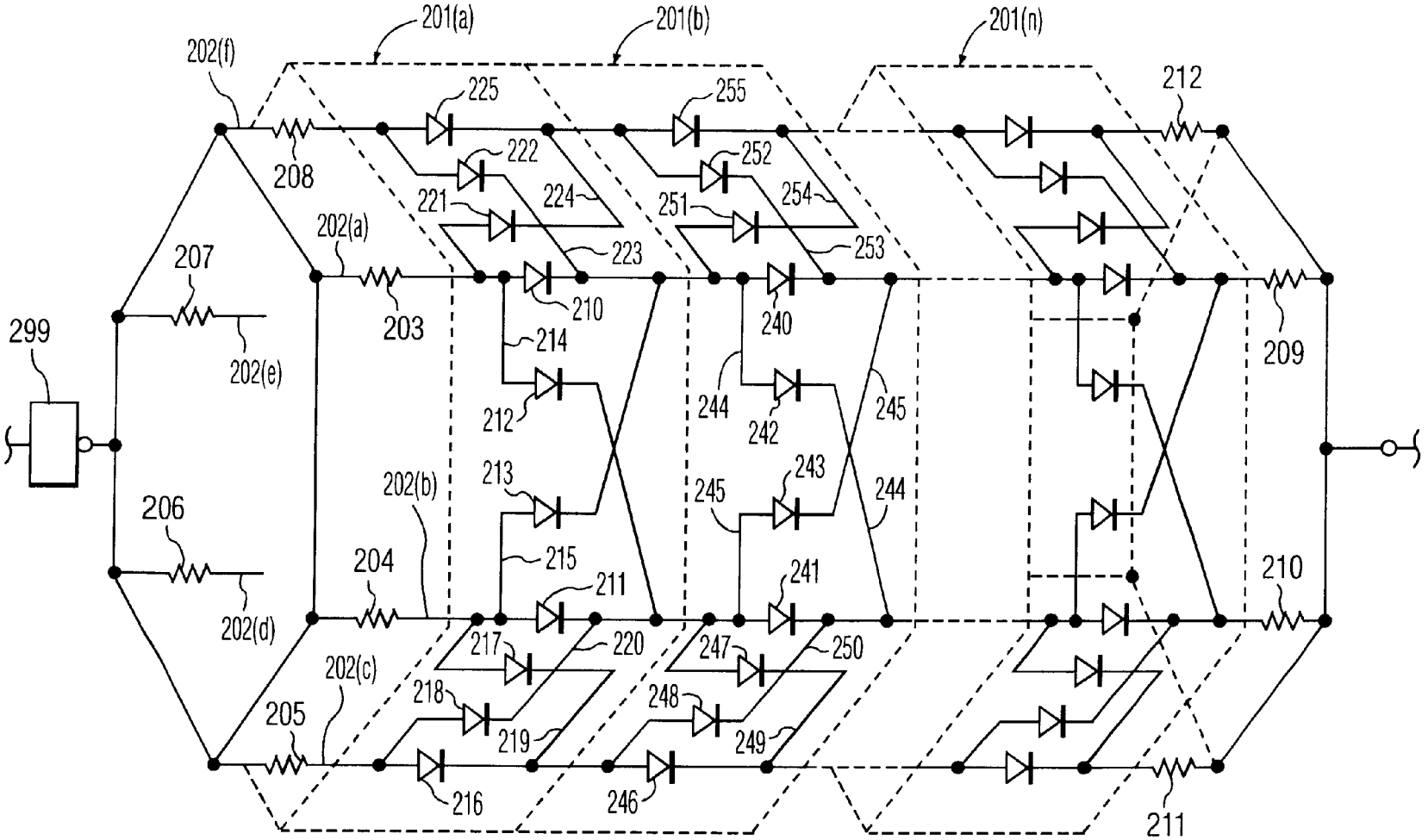
FIG. 4(*a*) illustrates another three-dimensional arrangement of light-emitting diodes, in accordance with one embodiment of the present invention.
Figure 4B:
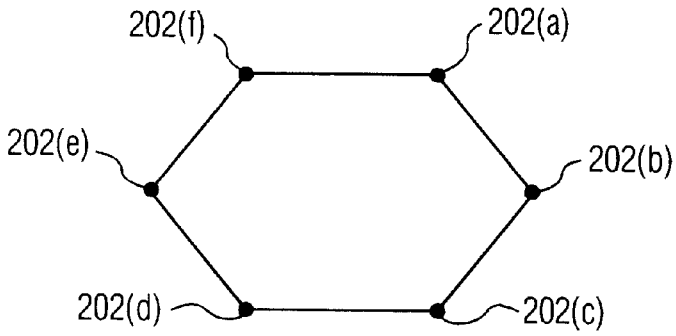
Figure 4C:
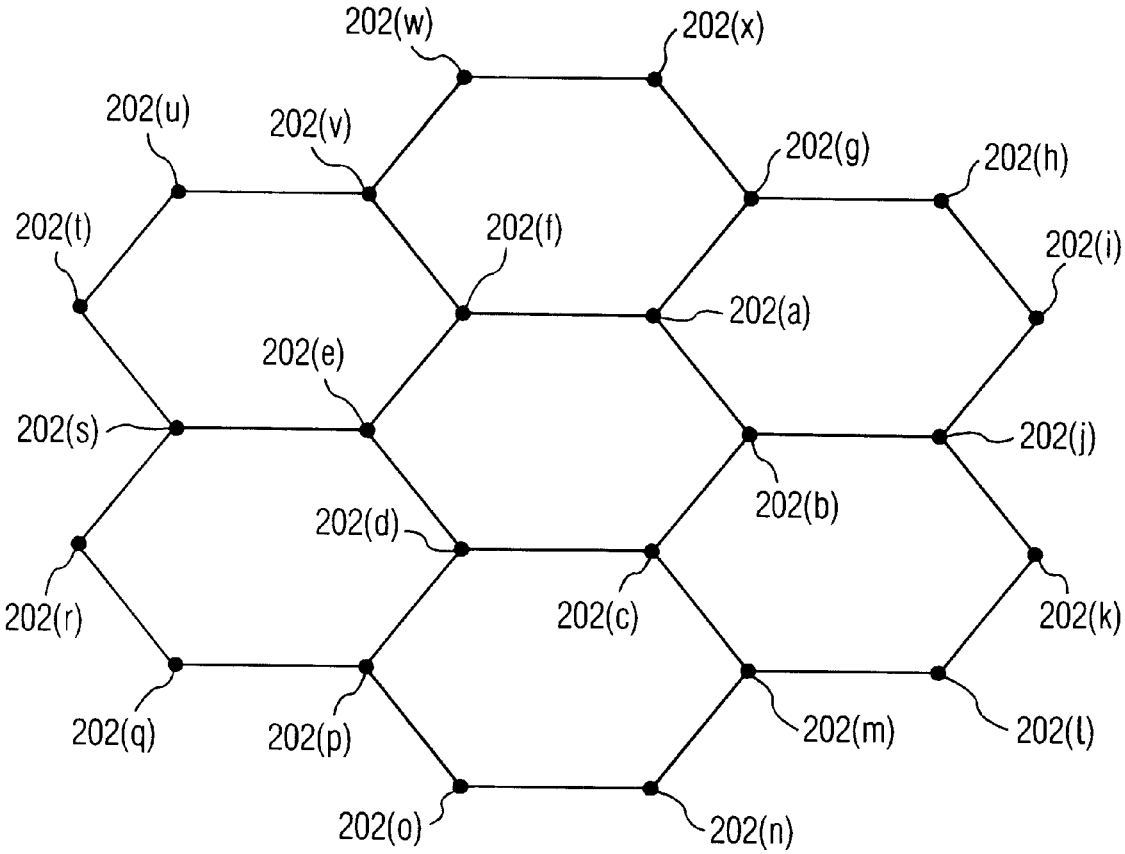

FIG. 4(*a*) illustrates a three-dimensional arrangement 200 of light-emitting diodes, as employed by a lighting system, according to another embodiment of the present invention. The arrangement shown in FIG. 4(*a*) again illustrates a three-dimensional lattice structure having cascading cells 201(*a*), 201(*b*) through 201(*n*) of light-emitting diodes. In accordance with various embodiments of the present invention, any number of cells 201 may be connected in cascading fashion. It is noted that, in accordance with other embodiments of the present invention and as previously mentioned, the arrangement may be configured such that each of the light-emitting diodes is arranged on a panel for display.

In the embodiment shown in FIG. 4(*a*), the lighting system comprises six branches and has a hexagonal cross-section. The hexagonal cross-section is also illustrated in FIG. 4(*b*), although the present invention is not limited in scope in this regard. Each of the branches 202(*a*) through 202(*f*) of FIG. 4(*a*) is designated as branch end nodes 202(*a*) through 202(*f*) in FIG. 4(*b*). FIG. 4(*c*) illustrates another embodiment, in which the hexagonal cross-section is repeated, on each of its sides, so as to form six additional hexagonal cross-sections with a total of twenty-four branches, wherein the end of each branch is designated by branch end nodes 202(*a*) through 202(*x*). The present invention contemplates that any number of branches and any shape of cross-section may be employed.

Returning to FIG. 4(*a*), each cell 201 of arrangement 200 comprises corresponding light-emitting diodes from six branches 202(*a*) through 202(*f*). Branches 202(*a*) through 202(*f*) are initially (i.e.—before the first cell) coupled in parallel via resistors 203 through 208, respectively. The resistors preferably have the same resistive values, to insure that an equal amount of current is received via each branch. Power supply source 299 provides current to the light-emitting diodes via resistors 203 through 208. Additional resistors (such as those shown as resistors 209 through 212) are employed in arrangement 200 at the cathode terminals of the last light-emitting diodes in the arrangement shown.

In each cell, the anode terminal of the light-emitting diode in a branch is coupled to the cathode terminal of the light-emitting diode in an adjacent branch by a shunt having a light-emitting diode connected therein. Thus, between adjacent branches 202(*a*) and 202(*b*), the anode terminal of light-emitting diode 210 is coupled to the cathode terminal of light-emitting diode 211 by shunt 214 having light-emitting diode 212 connected therein. In addition, the anode terminal of light-emitting diode 211 is coupled to the cathode terminal of light-emitting diode 210 by shunt 215 having light-emitting diode 213 connected therein.

Similarly, between adjacent branches 202(*b*) and 202(*c*), the anode terminal of light-emitting diode 211 is connected to the cathode terminal of light-emitting diode 216 by shunt 220. Shunt 220 has light-emitting diode 218 connected therein. The anode terminal of light-emitting diode 216 is connected to the cathode terminal of light-emitting diode 211 by shunt 219. Shunt 219 has light-emitting diode 217 connected therein. In addition, between adjacent branches 202(*f*) and 202(*a*), the anode terminal of light-emitting diode 225 is connected to the cathode terminal of light-emitting diode 210 by shunt 223. Shunt 223 has light-emitting diode 222 connected therein. The anode terminal of light-emitting diode 210 is connected to the cathode terminal of light-emitting diode 225 by shunt 224. Shunt 224 has light-emitting diode 221 connected therein.

Though not shown in FIG. 4(*a*), additional lights emitting diodes are coupled to branches 202(*d*) and 202(*e*), each of which are also coupled to adjacent branches so as to have shunts with light-emitting diodes therebetween. In addition, it is noted that, in accordance with various other embodiments of the present invention, each of the branches in a cell may be coupled via shunts to any or all of the other branches in the cell, not merely those that are closest in proximity thereto. Thus, for example, branch 202(*a*) may be coupled via shunts to 202(*c*), 202(*d*) or 202(*e*) in addition to be coupled to branches 202(*b*) and 202(*f*) as shown in FIG. 4(*a*).

Light-emitting diodes which are connected according to the three-dimensional arrangement shown in FIG. 4(*a*) have a high level of reliability because, in open-circuit failure mode, an entire branch does not extinguish because of the failure of a light-emitting diode in that branch. Instead, current flows via the shunts (e.g.—shunts 214 or 215, etc.), to bypass a failed light-emitting diode. For instance, if light-emitting diode 211 of FIG. 4(*a*) fails and is an open circuit, current still flows to (and thereby illuminates) light-emitting diode 241 via branch 202(*a*) and light-emitting diode 212, and via branch 202(*c*) and light-emitting diode 218. In addition, current from branch 202(*b*) still flows to the adjacent branches 215 and 219.

Furthermore, in short-circuit failure mode, light-emitting diodes in other branches and shunts do not extinguish because of the failure of a light-emitting diode in one branch. This follows because the light-emitting diodes are not connected in parallel. For example, if light-emitting diode 210 short circuits, current will flow through upper branch 202(*a*), which has no voltage drop, and will also flow through light-emitting diodes 212 and 221 in shunts 214 and 224, respectively. Light-emitting diodes 212 and 221 remain illuminated because the current flowing through them drops only a small amount, unlike that which occurs in the arrangement of FIG. 2(*b*). Light-emitting diodes 211, 216, etc. and the shunts which are coupled to their input terminals, also remain illuminated because a current flow is maintained through them via branches 202(*b*) through 202(*f*).

As in the previously described embodiments, the light-emitting diode arrangement shown in FIG. 4(*a*) also alleviates the problem experienced by the arrangements of the prior art, which require that the light-emitting diodes in a cell have tightly matched forward voltage characteristics. For instance, the light-emitting diodes in cell 201 of arrangement 200, specifically light-emitting diodes 210 through 225, are not parallel-connected to each other such as to cause the current flow through an light-emitting diode having a lower forward voltage to increase in order to equalize the forward voltage of the light-emitting diode with the higher forward voltage of another light-emitting diode. Thus, the present invention reduces the additional manufacturing costs and time which is necessitated by the binning operation of prior art light-emitting diode arrangements.

Figure 5A:
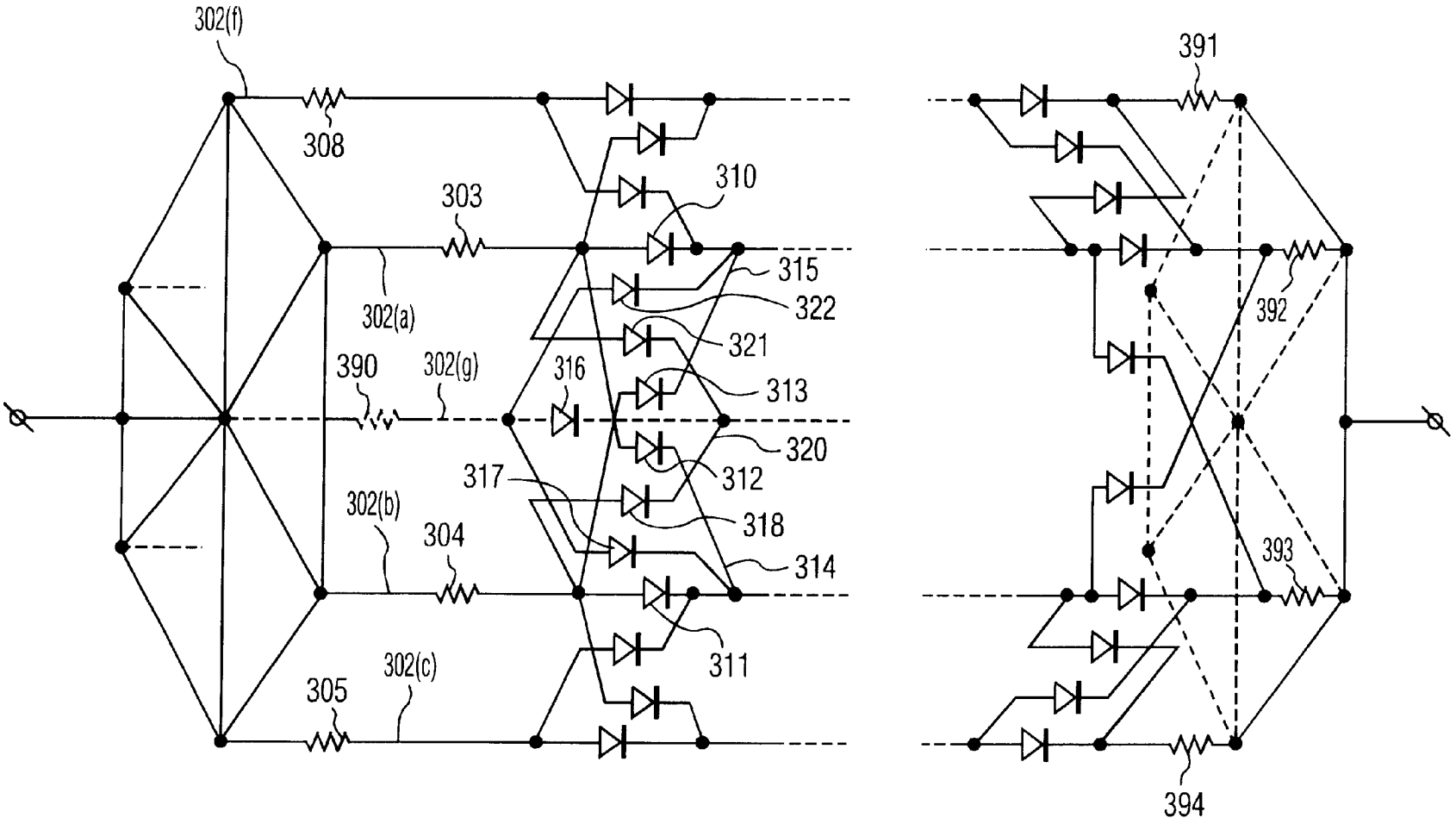
FIG. 5(*a*) illustrates still another three-dimensional arrangement of light-emitting diodes, in accordance with one embodiment of the present invention.
Figure 5B:
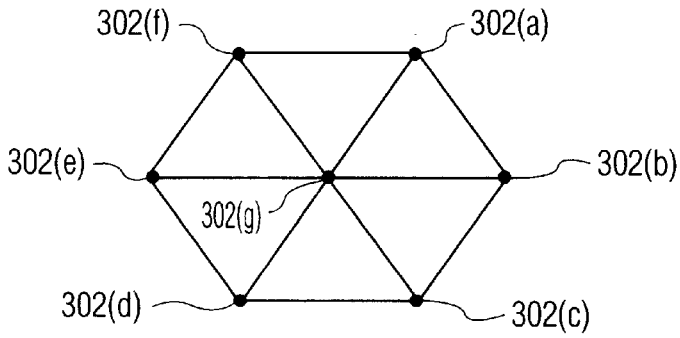
Figure 5C:
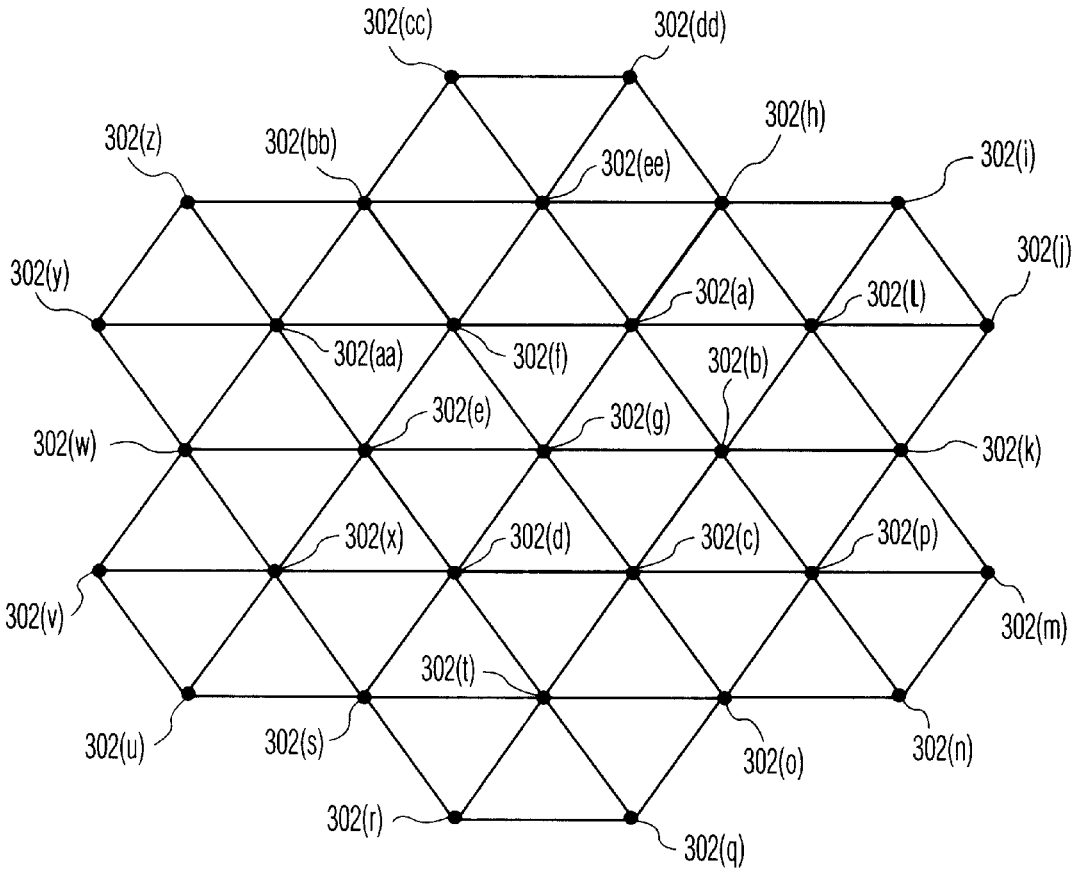

FIG. 5(*a*) illustrates a three-dimensional arrangement 300 of light-emitting diodes, as employed by a lighting system, according to still another embodiment of the present invention. The arrangement shown in FIG. 5(*a*) again illustrates a three-dimensional lattice structure having cascading cells 301 of light-emitting diodes. It is noted that, in accordance with various embodiments of the present invention, any number of cells 301 may be connected in cascading fashion.

In the embodiment shown in FIG. 5(*a*), the lighting system comprises seven branches (six outer branches and one central branch) and has a hexagonal cross-section. The hexagonal cross-section is also illustrated in FIG. 5(*b*), although the present invention is not limited in scope in this regard. Each of the branches 302(*a*) through 302(*g*) of FIG. 5(*a*) is designated as branch end nodes 302(*a*) through 302(*g*) in FIG. 5(*b*). FIG. 5(*c*) illustrates another embodiment, in which the hexagonal cross-section is repeated, on each of its sides, so as to form six additional hexagonal cross-sections with a total of thirty-one branches, wherein the end of each branch is designated by branch end nodes 302(*a*) through 302(*ee*). The present invention contemplates that any number of outer branches and central branches may be employed. It is also noted that the terms "outer" and "central" merely describe one possible proximity, and that the arrangement may be configured differently from that shown in FIG. 5(*a*).

Returning to FIG. 5(*a*), arrangement 300 comprises branches 302(*a*) through 302(*g*), each branch having a plurality of light-emitting diodes coupled in series. A set of corresponding light-emitting diodes of each branch (together with coupling shunts which are further explained below), comprises a cell unit. Each cell 301 of arrangement 300 comprises a set of corresponding light-emitting diodes from the six outer branches 302(*a*) through 302(*f*). In addition, cells 301 comprises a central branch 302(*g*), to which, according to one embodiment, each of the outer branches are connected. According to various other embodiments of the invention, central branch 302(*g*) is coupled to one or more of outer branches 302(*a*) through 302(*f*). Though only a single central branch is shown in FIG. 5(*a*), the present invention contemplates that more than one centrally-disposed branches may be employed.

As previously mentioned, each cell 301 of arrangement 300 comprises a first light-emitting diode (such as light-emitting diode 310) of branch 302(*a*), a first light-emitting diode (such as light-emitting diode 311) of branch 302(*b*), and a first light-emitting diode (such as light-emitting diode 316) of central branch 302(*g*). Each of the branches having the light-emitting diodes are initially (i.e.—before the first cell) coupled in parallel via resistors (such as resistors 303, 304, 305, 308, 390). The resistors preferably have predetermined resistive values, to insure that an equal amount of current is received via each branch.

The anode terminal of the light-emitting diode in each branch is coupled to the cathode terminal of corresponding light-emitting diodes in other branches. For example, the anode terminal of light-emitting diode 310 is connected to the cathode terminal of light-emitting diode 311 by a shunt (such as shunt 314) having a light-emitting diode (such as light-emitting diode 312) connected therein. Furthermore, the anode terminal of light-emitting diode 310 is connected to the cathode terminal of light-emitting diode 316 by a shunt (such as shunt 324) having a light-emitting diode (such as light-emitting diode 321) connected therein.

Similarly, the anode terminal of light-emitting diode 311 is connected to the cathode terminal of light-emitting diode 310 by a shunt (such as shunt 315) having a light-emitting diode (such as light-emitting diode 313) connected therein. The anode terminal of light-emitting diode 311 is also connected to the cathode terminal of light-emitting diode 316 by a shunt (such as shunt 320) having a light-emitting diode (such as light-emitting diode 318) connected therein. Power supply source 304 provides a current signal to the light-emitting diodes via resistors 303 through 308. Additional resistors 391, 392, etc. are employed in arrangement 300 at the cathode terminals of the last light-emitting diodes in each branch.

Light-emitting diodes which are connected according to the arrangement shown in FIG. 5(*a*) have a high level of reliability. This follows because, in open-circuit failure mode, an entire branch does not extinguish because of the failure of a light-emitting diode in that branch. Instead, current flows via shunts 314, 315, etc. to bypass a failed light-emitting diode. For instance, if light-emitting diode 310 of FIG. 5(*a*) fails, current still flows to (and thereby illuminates) other light-emitting diodes in branch 302(*a*) via branch 302(*b*) and light-emitting diode 313, and via branch 302(*g*) and light-emitting diode 322. In addition, current from branch 302(*a*) still flows to adjacent branches 302(*b*) and 302(*c*) via shunts 314 and 324, respectively.

Furthermore, in short-circuit failure mode, light-emitting diodes in other branches and shunts do not extinguish because of the failure of a light-emitting diode in one branch. This follows because the light-emitting diodes are not connected in parallel. For example, if light-emitting diode 310 short circuits, current will flow through upper branch 302(*a*), which has no voltage drop, and will also flow through light-emitting diodes 312 and 321 in shunts 314 and 324, respectively. Light-emitting diodes 312 and 321 remain illuminated because the current flowing through them drops only a small amount, unlike that which occurs in the arrangement of FIG. 2(*b*). Light-emitting diodes 311 and 316, and the shunts which are coupled to their input terminals, also remain illuminated because a current flow is maintained through them via branches 302(*b*) through 302 (*g*).

In addition, arrangement 300 of light-emitting diodes also alleviates other problems experienced by the light-emitting diode arrangements of the prior art. For instance, light-emitting diode arrangement 300 of the present invention, according to one embodiment, insures that all of the light-emitting diodes in the arrangement have the same brightness without the requirement that the light-emitting diodes have tightly matched forward voltage characteristics. For instance, light-emitting diodes 310, 311, 312, 313, 316, 317, 318, 321 and 322 of the arrangement shown in FIG. 5(*a*) may have forward voltage characteristics which are not as tightly matched as the forward voltage characteristics of light-emitting diodes 51, 61, 71 and 81 of the arrangement shown in FIG. 2(*b*). This follows because, unlike the arrangements of the prior art, the light-emitting diodes in cells 301 of arrangement 300 are not parallel-connected to each other.

As in the previously described embodiments, because light-emitting diodes in each cell of arrangement 300 are not parallel-connected, the voltage drop across the diodes does not need to be the same. Therefore, forward voltage characteristics of each light-emitting diode need not be equal to others in order to provide similar amounts of illumination, and the current flow through a light-emitting diode having a lower forward voltage will not increase in order to equalize the forward voltage of the light-emitting diode with the higher forward voltage of another light-emitting diode. By alleviating the need for binning light-emitting diodes with tightly matched voltage characteristics, the present invention reduces the additional manufacturing costs and time which is necessitated by the binning operation of prior art light-emitting diode arrangements.

As previously mentioned, in accordance with various embodiments, the three-dimensional light-emitting diode arrangement of the present invention enables the lighting system to be viewed from various different directions. As a result, the lighting system of the present invention is particularly well-suited for applications such as desk lamps, traffic signals, safety lights, advertising signs, etc. By contrast, most of the light-emitting diode arrangements of the prior art are configured to be viewed from substantially a single direction.

While there has been shown and described particular embodiments of the invention, it will be obvious to those skilled in the art that changes and modifications can be made therein without departing from the invention, and therefore, the appended claims shall be understood to cover all such changes and modifications as fall within the true spirit and scope of the invention.

What is claimed is:

1. A lighting system comprising:

a power supply source;

a plurality of electrically-conductive branches configured in a three-dimensional arrangement, said branches coupled in parallel to said power supply source, each of said branches comprising at least one light-emitting diode; and a plurality of shunts, wherein each one of said shunts couples an anode terminal of a light-emitting diode in one of said branches to a cathode terminal of a corresponding light-emitting diode in a different branch, such that a corresponding set of light-emitting diodes together with their corresponding coupling shunts define a cell.

2. The lighting system according to claim 1, wherein a cross-section of said plurality of branches is triangular.

3. The lighting system according to claim 2, wherein each side of said cross-section further comprises additional triangular sections so as to form additional branches.

4. The lighting system according to claim 1, wherein a cross-section of said plurality of branches is hexagonal.

5. The lighting system according to claim 1, wherein each side of said cross-section of said plurality of branches further comprises additional hexagonal sections so as to form additional branches.

6. The system according to claim 1, wherein each one of said shunts couples an anode terminal of a light-emitting diode in one of said branches to a cathode terminal of a corresponding light-emitting diode in an adjacent branch.

7. The system according to claim 1, wherein, for each said light-emitting diode, said anode terminal is coupled to the cathode terminal of at least two corresponding light-emitting diodes.

8. The lighting system according to claim 1, wherein said plurality of branches further comprises at least one central branch.

9. The lighting system according to claim 4, wherein at least one of said plurality of branches is coupled via a shunt to said at least one central branch.

10. The lighting system according to claim 1, wherein said three-dimensional arrangement of light-emitting diodes is visible from a plurality of different directions.

11. The lighting system according to claim 1, wherein said shunts comprise a light-emitting diode.

12. The lighting system according to claim 1, wherein each said branch further comprises a resistor.

13. The lighting system according to claim 12, wherein for each said branch, said resistor is a first element.

14. The lighting system according to claim 12, wherein for each said branch, said resistor is a last element.

15. The lighting system according to claim 1, wherein light-emitting diodes of each one of said cells have different forward voltage characteristics.

16. A method of lighting comprising the steps of:

coupling in parallel a plurality of electrically-conductive branches in a three-dimensional arrangement;

with said branches, forming at least one cell, wherein in each said cell, each said branch has a light-emitting diode having an anode terminal and a cathode terminal;

within each cell, coupling the anode terminal of each said light-emitting diode to the cathode terminal of a corresponding light-emitting diode in a different branch via a shunt; and providing power to said branches via a power supply.

17. The method according to claim 16, wherein said method further comprises the step of coupling said branches so as to have a triangular cross-section.

18. The method according to claim 17, wherein said method further comprises the step of forming additional branches by repeating on each side of said cross-section additional triangular sections.

19. The method according to claim 16, wherein said method further comprises the step of coupling said branches so as to have a hexagonal cross-section.

20. The method according to claim 19, wherein said method further comprises the step of forming additional branches by repeating on each side of said cross-section additional hexagonal sections.

21. The method according to claim 16, wherein said method further comprises the step of coupling an anode terminal of a light-emitting diode in each of said branches to a cathode terminal of a corresponding light-emitting diode in an adjacent branch.

22. The method according to claim 16, wherein said method further comprises the step of coupling, for each said light-emitting diode, said anode terminal to the cathode terminal of at least two corresponding light-emitting diodes.

23. The method according to claim 16, wherein said method further comprises the step of coupling to said plurality of branches at least one central branch.

24. The method according to claim 23, wherein said method further comprises the step of coupling at least one of said plurality of branches via a shunt to said at least one central branch.

25. The method according to claim 16, wherein said method further comprises the step of configuring said three-dimensional arrangement of light-emitting diodes so as to be visible from a plurality of different directions.

26. The method according to claim 16, wherein said method further comprises the step of coupling to each one of said plurality shunts a light-emitting diode.

27. The method according to claim 16, wherein said method further comprises the step of coupling to each said branch a resistor.

28. The method according to claim 27, wherein said method further comprises the step of coupling to each said branch a resistor as a first element of each said branch.

29. The method according to claim 27, wherein said method further comprises the step of coupling to each said branch a resistor as a last element of each said branch.

* * * * *